US005694782A

United States Patent [19]

Alsenz

[11] Patent Number: 5,694,782

[45] Date of Patent: Dec. 9, 1997

[54] REVERSE FLOW DEFROST APPARATUS AND METHOD

[76] Inventor: Richard H. Alsenz, 1545 Industrial Dr., Missouri City, Tex. 77489

[21] Appl. No.: 465,945

[22] Filed: Jun. 6, 1995

[51] Int. Cl.[6] ..... F25B 47/02

[52] U.S. Cl. ..... 62/156; 62/197; 62/278

[58] Field of Search ..... 62/199, 200, 81, 62/156, 278, 277, 197, 196.4

[56] References Cited

U.S. PATENT DOCUMENTS

| | | | |
|---|---|---|---|
| 3,316,731 | 5/1967 | Quick | 62/196.4 |
| 3,427,819 | 2/1969 | Seghetti | 62/278 X |
| 4,437,317 | 3/1984 | Ibrahim | 62/156 X |
| 4,625,524 | 12/1986 | Kimura et al. | 62/278 |
| 4,688,390 | 8/1987 | Sawyer | 62/197 X |
| 5,396,780 | 3/1995 | Bendtsen | 62/212 |

OTHER PUBLICATIONS

*Principles of Refrigeration*, Third Edition: Roy J. Dossat, Prentice Hall Career & Technology, 1991, (466 pgs.);Englewood Cliff, New Jersey.

*Primary Examiner*—Harry B. Tanner

*Attorney, Agent, or Firm*—Conley, Rose & Tayon, PC; David A. Rose

[57] ABSTRACT

The present invention provides a closed loop vapor cycle refrigeration system that includes a compressor, a condenser, an evaporator system having at least two parallel evaporator coils, means for discharging the compressed gas refrigerant into the outlet ends of each of the parallel evaporator coils and a flow control means coupled to the inlet end of each of the parallel evaporator coils. In an embodiment, a flow control valve is used as the flow control means. The flow control valves are independently controlled by a control circuit. During the defrost cycle, the control circuit closes each flow control valve when the temperature at the inlet end of its associated evaporator coil reaches or exceeds a preset value to ensure that no gas refrigerant passes from its associated evaporator coil to other elements of the refrigeration system during the defrost cycle. In another embodiment of the flow control means, a check valve, serially coupled with a velocity pressure drop device, is placed at the inlet end of each of the parallel evaporator coils to ensure that the inlet end of each of the parallel evaporator coils remains open so long as the compressed gas is discharged into their associated evaporator coils.

24 Claims, 2 Drawing Sheets

REVERSE FLOW DEFROST APPARATUS AND METHOD

FIELD OF THE INVENTION

This invention relates generally to a closed loop vapor cycle refrigeration system, and more particularly to apparatus and methods for defrosting the evaporator coils of the refrigeration system.

DESCRIPTION OF THE RELATED ART

Refrigeration systems, such as used in supermarkets for cooling food storage fixtures, contain a compressor system having one or more compressors for compressing a refrigerant fluid, a condenser for condensing the compressed refrigerant to a liquid, one or more evaporator systems, each such evaporator system often having a plurality of parallel evaporator coils with associated expansion valves, each evaporator coil being used to cool a different fixture. The different fixtures are typically used to store different products, such as the dairy products, meat products, frozen foods, etc. The refrigeration demand on different fixtures is generally different and such fixtures are often kept at different temperatures.

During normal operation of the refrigeration system, the evaporators operate at temperatures low enough to cause water vapor to crystallize on the evaporator coils, producing "frost" which reduces the efficiency of the refrigeration system. The rate at which the ice builds up on a particular fixture depends upon the type of the fixture, the load on the fixture, the temperatures of the fixture and refrigerant, and the humidity of the air within the fixture being cooled.

As a result, the surfaces of the evaporator coils must periodically be defrosted. The frequency with which a particular evaporator must be defrosted depends on the rate at which ice builds up, the cooling load on the evaporator, and the rate at which it can be defrosted. In general, the length of the defrost period is determined by the degree of ice accumulation on the evaporator and by the rate at which heat can be applied to melt off the ice. Ice accumulation will therefore vary with the type of installation, the conditions inside the fixture, and the frequency of defrosting.

Defrosting may be accomplished in a number of different ways, each of which can be classified as either "natural defrosting" or "supplementary-heat defrosting" according to the source of heat used to melt the ice from the evaporator coils. Natural defrosting utilizes the heat of the air in the refrigerated fixture to melt the frost from the evaporator, whereas supplementary-heat defrosting is accomplished with heat supplied from sources other than the fixture air. Common sources of supplementary heat include electric heating elements and hot gas from the discharge of the compressor. All methods of natural defrosting require that the evaporator system be shut down for a period of time sufficient for the temperature of refrigerant in the evaporator to rise to a level well above the melting point of the ice.

Another common method is reverse cycle defrosting. The hot gas refrigerant from the exhaust of the compressor or the cooler gas from the receiver flows into the outer of the evaporator such that the gas heats the cold evaporator by condensing to the liquid state.

Various apparatus and methods have been used for reverse cycle defrosting of the evaporator coils. One common method for reverse cycle defrosting includes a one-way check-valve placed in parallel with an expansion valve at the inlet end of each evaporator coil. Such a check-valve contains a compression spring that determines the pressure differential for the check-valve. When the pressure drop across the check-valve is greater than the set pressure differential for that check-valve, it opens and remains open as long as the pressure drop remains above the pressure differential for that valve. The pressure differential for the check-valves varies due to the variation in the compression force of the springs. As an example and not by way of limitation, the pressure differential range for a set of one way check-valves used in a refrigeration system may be between 0.2 to 0.8 psi. One of the problems with check valves in reverse-cycle defrost, is that shortly after initiating defrost, the frost melts and the refrigerant then ceases to condense, causing the refrigerant to remain as a gas as it flows through the check valve.

To effect reverse cycle defrost of the evaporator coils, the flow of liquid refrigerant is stopped and compressed gas refrigerant is discharged into the outlet ends of the evaporator coils (reverse flow). Because each evaporator coil is at a relatively low temperature, the compressed gas condenses in each of the evaporator coils as it gives up heat to the cold evaporator coil. The pressure drop across the check-valves causes the check-valves to open allowing condensed refrigerant to discharge from what are normally the inlets to the evaporator coils.

The evaporator coils tend to defrost at different rates due to the varying nature of the fixtures and the variable amount of the ice that builds up. One of the difficulties of the prior art defrosting systems is that upon turning off the flow of liquid refrigerant from the receiver to the evaporators, a significant pressure drop develops in reverse flow through one or more evaporators. When an evaporator coil has become sufficiently warm, the compressed refrigerant ceases to liquefy in that coil and the gas passes in reverse flow through the inlet end of that coil to other evaporator coils or to other elements of the refrigeration system, which is highly undesirable. If the pressure drop in reverse flow across the check valves at the inlet of the evaporator coils becomes significant, different pressure drops may be created between the inlets of the various evaporator coils. Thus, if the pressure drop across one check valve is greater than the pressure drop across another check valve, the refrigerant will tend to flow through the smaller pressure drop and the evaporator coil with the larger pressure drop will no longer defrost. Additionally, the check-valve having the least pressure differential remains open as long as the gas is being discharged into its associated evaporator coil while the remaining check-valves may remain open for shorter periods of time or may not open at all, thereby causing only some of the evaporator coils to defrost adequately. The refrigeration system may therefore need to be shut down for much longer periods of time to allow the remaining coils to defrost, which also is not desirable.

It is, therefore, desirable to have a refrigeration system which eliminates or reduces the above-identified problems and provides a more efficient means for defrosting the evaporator coils. The present invention overcomes the above-identified problems and provides apparatus and methods for efficiently defrosting the evaporator coils of such refrigeration systems.

SUMMARY OF THE INVENTION

The present invention provides a closed loop vapor cycle refrigeration system that includes a compressor for compressing a refrigerant fluid, a condenser for condensing the compressed gas refrigerant into a liquid refrigerant, a receiver for storing the liquid and compressed gas refrigerants, at least two parallel evaporator coils for evaporating the liquid refrigerant to the low pressure gas refrigerant, control valves for discharging either the compressed gas refrigerant or liquid refrigerant into the evaporator coils for defrosting the parallel evaporator coils and flow controls for controlling the flow through the evaporator coils during the defrost cycle.

In one embodiment of the present invention, the flow controls include an electronic flow control valve for controlling the flow of the refrigerant during normal operation and also during the defrost cycle. In such an embodiment, an electronic flow control valve is placed at what is normally the inlet end of each of the parallel evaporator coils. Temperature and/or pressure sensors are placed at the inlet end and at the outlet end of each of the parallel evaporator coils. During the reverse flow defrost cycle, the compressed gas refrigerant is discharged into what is normally the discharge of each of the parallel evaporator coils. The compressed gas refrigerant condenses in the evaporator coils and discharges through the inlet end of the evaporator coils.

A control circuit controls the flow of the refrigerant through each of the flow control valves to minimize the flow of gas passing through any of the control valves during the defrost cycle. This may be accomplished by ensuring that the refrigerant liquid is subcooled. The control circuit and control valves, in conjunction with temperature and/or pressure sensors are used to maintain sub-cooled liquid as it leaves the coil. Thus, the gas refrigerant is apportioned between the evaporator coils so that the thermal energy transferred to the evaporator coils by the compressed gas refrigerant during the reverse flow defrost cycle is distributed appropriately. Thus an evaporator coil that is more heavily frosted will receive more thermal energy during the defrost cycle than a coil that is only lightly frosted. Defrost is terminated by closing the control valve when the temperature at the inlet end of its associated evaporator coil reaches a predetermined value.

In another embodiment of the present invention, reverse flow of liquid refrigerant is used to defrost the evaporator coils. In this embodiment liquid refrigerant, rather then refrigerant gas, from a refrigerant receiver or liquid line passes through the evaporator coils in reverse flow. The defrosting refrigerant liquid is subcooled by losing heat in reverse flow, melting accumulated frost on the evaporator coils.

In yet another embodiment of the present invention, the flow controls include an expansion valve coupled to the inlet end of each of the parallel evaporator coils. A one way check-valve is serially coupled to a velocity pressure drop means and placed in parallel with each of the expansion valves. During the defrost cycle, the compressed gas refrigerant is discharged into the outlet ends of the parallel evaporator coils. The velocity pressure drop means causes the pressure drop across the combination of the velocity pressure drop means and its associated one-way check valve to be greater than the largest pressure drop across any one of the check-valves used in an evaporator system, thereby ensuring that all check-valves remain open during the entire defrost cycle regardless of the difference in the differential pressure of the check-valves.

An additional advantage of the present invention is that either embodiment described above may be implemented in existing refrigeration systems to increase defrost effectiveness.

Important features of the present invention have been broadly summarized above in order that the following detailed description thereof may be better understood, and in order that the contribution to the art may be better appreciated. There are, of course, many additional features of the present invention that will be described in detail hereinafter and which will form the subject of the claims appended hereto.

BRIEF DESCRIPTION OF THE DRAWINGS

The following is a brief description of the drawings of the present invention wherein like elements have been identified by like numerals.

DETAILED DESCRIPTION OF THE PREFERRED EMBODIMENTS

Figure 1:
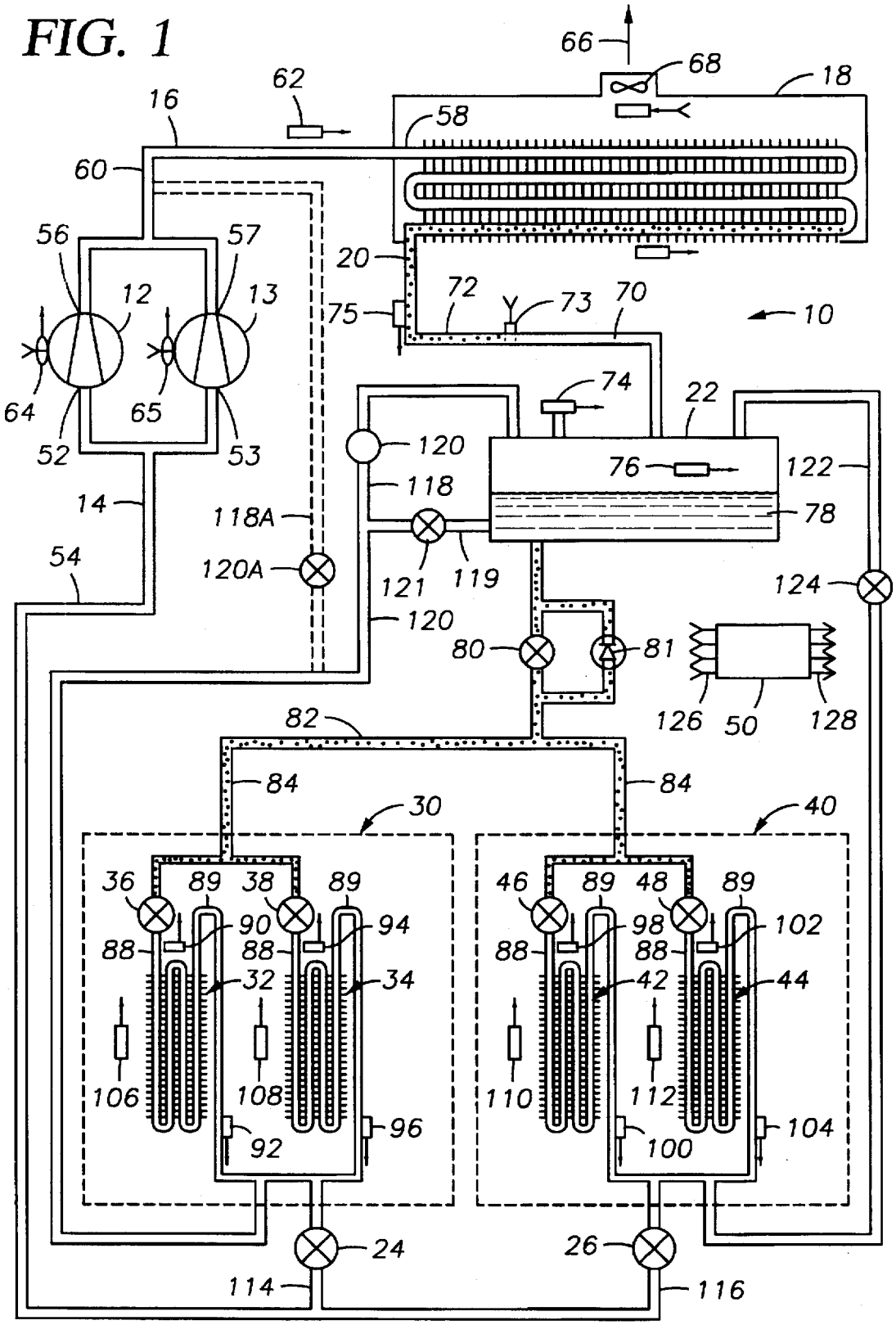
FIG. 1 shows a closed loop vapor cycle refrigeration system according to the present invention.

Referring initially to FIG. 1, there is shown an embodiment of a closed loop vapor cycle refrigeration system 10 according to the present invention. Refrigeration system 10 contains a plurality of parallel compressors 12, 13 for compressing a low pressure gas refrigerant 14 to a high pressure, high temperature gas refrigerant 16, a condenser 18 for condensing the compressed gas refrigerant 16 into a liquid refrigerant 20, a reservoir or receiver 22 for storing the liquid and compressed gas refrigerants 14, 20, a plurality of evaporator systems 30, 40 each having at least two parallel evaporator coils 32, 34 and 42, 44 respectively, means, such as control valves 120, 124, for selectively discharging the compressed gas refrigerant 14 into the evaporator coils 32, 34 and 42, 44 of the evaporator systems 30, 40 during the defrost cycle, flow controls 36, 38 and 46, 48 coupled to the inlet end of each evaporator coil 32, 34 and 42, 44, respectively, for controlling the refrigerant flow through their associated evaporator coils during the defrost cycle and during the normal operation of the refrigeration system 10. The operation of the refrigeration system is controlled by a control circuit 50.

Compressors 12, 13 then are coupled at their inlet end 52, 53 to a suction manifold 54 and at their outlet end 56, 57 to the condenser coil 58 of condenser 18 via a line 60. Compressors 12, 13 receive the low pressure gas refrigerant 14 from the suction manifold 54, compress it to the high pressure, high temperature gas refrigerant 16 and discharge the compressed gas refrigerant 16 into the condenser coil 58. A temperature sensor 62 is placed in the line 60 to provide signals (information) representative of the temperature of the compressed gas refrigerant 16 in the line 60. Also, temperature sensors 64, 65 are coupled to the compressors 12, 13 for providing signals representative of the temperature of the compressor crank cases.

The compressed gas refrigerant 16 condenses in the condenser 18 as air 66 is passed across the condenser coil 58 by a fan 68. The liquid refrigerant 20 from the condenser coil 58 discharges through a liquid return line 72 and into the receiver 22. A pressure sensor 74 and a liquid level sensor 76 are coupled to the receiver 22 for respectively providing signals representative of the pressure and the level of the liquid refrigerant 78 in the receiver 22. The liquid refrigerant 78 from the receiver 22 discharges through a solenoid operated valve 80 and into a manifold 82 containing a plurality of liquid lines, such as lines 84 and 86, to evaporator systems 30, 40. Solenoid operated valve 80, placed between the receiver 22 and the manifold 82, permits the liquid refrigerant 78 from the receiver 22 to flow into the manifold 82. A pressure differential valve 81 is coupled in parallel with solenoid operated valve 80. Pressure differential valve 81 may have a differential pressure setting, such that when solenoid valve 80 is closed, liquid refrigerant 78 flows from receiver 22 to manifold 82 if the receiver pressure is greater than the manifold pressure by a predetermined mount.

The liquid refrigerant 78 from the manifold 82 passes to the evaporator systems 30, 40 respectively via liquid lines 84 and 86. The liquid refrigerant on liquid line 84 passes through flow controls 36, 38 and into parallel evaporator coils 32, 34, respectively. Likewise, the liquid refrigerant from liquid line 86 passes through flow controls 46, 48 and into parallel evaporator coils 42, 44, respectively. The refrigeration system 10 of the present invention however, may contain any number of evaporator systems, each such system having any number of evaporator coils. The refrigeration system 10 may contain only one evaporator system, such as the evaporator system 30, having parallel evaporator coils, such as coils 32 and 34, or it may contain a plurality of evaporator systems, each evaporator system having any number of evaporator coils.

The flow controls 36, 38 and 46, 48 operated according to the present invention are placed between the inlet ends 88 Of coils 32, 34 and 42, 44 of each parallel evaporator coil and the manifold 82. In FIG. 1, flow controls 36, 38 are respectively coupled between the evaporator coils 32, 34 and the liquid line 84. Similarly, flow controls 46, 48 are respectively coupled between the inlet ends 88 of the evaporator coils 42, 44 and the liquid line 86.

A temperature sensor is placed at the inlet end 88 and at the outlet end 89 of each evaporator coil for providing signals representative of the temperatures at such inlet end 88 and outlet end 89. In the refrigeration system 10 of FIG. 1, temperature sensors 90, 92 are coupled to the inlet end 88 and outlet end 89 respectively, of the evaporator coil 32. Similarly, temperature sensors 94, 96 are coupled to the evaporator coil 34, temperature sensors 98, 100 to the evaporator coil 42 and temperature sensors 102, 104 to the evaporator coil 44. Additionally, a temperature sensor is placed at each evaporator coil to provide signals representative of the discharge air temperature for each such evaporator coil. Temperature sensors 106, 108, 110, and 112 respectively provide signals representative of the temperature of the discharge air for their associated evaporator coils 32, 34, 42, and 44. Additional sensors may be used in the refrigeration system 10 to obtain information about other system parameters, such as the compressor oil pressure, suction pressure, fan speed, etc.

The outlet ends 89 of the evaporator coils of each evaporator system are coupled to the compressors 12, 13 via a common suction line manifold 54. The outlet ends 89 of the evaporator coils 32, 34 are coupled to the suction line manifold 54 via a suction line 114 while the outlet ends 89 of the evaporator coils 42, 44 are coupled via a suction line 116. Flow control valves 24, 26 are respectively placed in the suction lines 114 and 116 to control the flow of the refrigerant from the evaporator systems 30, 40 to the suction line manifold 54 and hence the compressors 12, 13.

A line 118, coupled to the receiver 22, provides access by the evaporator systems 30, 40 to the compressed gas refrigerant in the receiver 22. Line 118 is also coupled to the suction line 114 to provide passage for the compressed gas to the outlet end 89 of the evaporator coils 32, 34 of the evaporator system 30. A control valve 120 is placed in the line 118 to control the flow of the gas refrigerant to the evaporator coils 32, 34. Similarly, a line 122 and a control valve 124 provide passage of the gas refrigerant to the coils 42, 44 of the evaporator system 40. Alternately or in addition to the line 118, a line 118A with a control valve 120A may be provided to discharge the compressed gas refrigerant from the line 60 to the line 118 and hence the evaporator coils 32, 34.

As noted earlier, the operation of the refrigeration system 10 of the present invention is controlled by a control circuit 50. Such a control circuit preferably is a microprocessor based circuit. A microprocessor based circuit typically contains, among other things, a microprocessor, analog to digital converters, switching circuitry, memory elements and other electronic circuitry. The use of circuits containing microprocessors and circuits containing discrete electronic components to control the operation of refrigeration systems is known in the electrical engineering art and is, therefore, not described in greater detail here.

The control circuit 50 is operatively coupled to each of the sensors via input ports 126 for receiving electrical signals from the sensors and is coupled via output ports 128 to the refrigeration system elements, such as compressors 12, 13, fan 68, control valves 24, 26, 120 and 124, and the flow controls 36, 38, 46 and 48 for controlling the operation of the refrigeration system 10. The control circuit 50 receives signals from the various sensors in the refrigeration system 10 and in response thereto and in accordance with programmed instructions controls the operation of the various system elements.

During normal operation, the flow control valves 120, 124 remain closed while the valves 24, 26 remain open. Compressors 12, 13 receive the low pressure gas 14 from the evaporator systems 30, 40 via the suction line manifold 54 and compress the low pressure gas 14 to a high pressure, high temperature gas refrigerant 16. The compressed gas refrigerant 16 passes via the line 60 to the condenser coil 58, wherein it condenses as the air 66 is passed over the condenser coil 58 by the fan 68. The air passing over the condenser coil 58 removes thermal energy from the gas refrigerant 16 in the coil 58, thereby causing the gas refrigerant to condense.

The liquid refrigerant 20 from the condenser coil 58 discharges via the liquid return line 72 into the receiver 22. The liquid refrigerant 78 from the receiver 22 passes to the evaporator coils 32, 34 and 42, 44. The flow controls 36, 38 and 46, 48 meter the refrigerant flow into their associated evaporator coils 32, 34 and 42, 44, respectively. The liquid refrigerant 78 evaporates in the evaporator coils 32, 34 and 42, 44 into a low pressure gas refrigerant and discharges into the associated suction lines 114, 116. For example, the low pressure gas from the evaporator coils 32, 34 discharges into the suction line 114 while the gas refrigerant from the evaporator coils 42, 44 discharges into the suction line 116. The low pressure gas refrigerant 14 from the suction lines 114, 116 and the like discharges into the common suction line manifold 54, from where it is compressed by the compressors 12, 13, repeating the closed loop vapor cycle.

During normal operation of the refrigeration system 10 described above, the control circuit 50 receives signals from the various sensors in the refrigeration system 10 and in response thereto and in accordance with instructions provided to the control circuit 50 by a software means controls the operation of the various system elements including refrigerant flow into the evaporator coils 32, 34 and 42, 44. For example, the control circuit 50 may be programmed to control the refrigerant flow into an evaporator coil as a function of the superheat, which may be measured as the difference between the temperature at the coil outlet 89 and the temperature at the coil inlet 88. Also, as an example, the operation of the compressors 12, 13 may be controlled as a function of the suction pressure. Similarly, the operation of other system elements may be controlled as a function of certain desired system parameters. Additionally, other control criteria may be used to control the operation of the elements of the refrigeration system 10. The apparatus and methods used in the refrigeration system 10 of the present invention during the defrost cycle are described below.

In one embodiment of the present invention, the flow controls 36, 38 and 46, 48 include electronic control valves connected and controlled by control circuit 50. The operation of the refrigeration system 10 during the defrost cycle when electronic control valves are used is described below with respect to the evaporator system 30, and is equally applicable to the other evaporator system 40 in the refrigeration system 10.

To effect defrost of the evaporator coils 32, 34 in the evaporator system 30, reverse flow is effected through evaporator coils 32, 34. The solenoid operated valve 80 is actuated to the closed position. This allows flow of liquid from receiver 22 to manifold 82, only through pressure differential valve 81. Pressure differential valve 81 will allow flow only when the pressure across it exceeds a threshold value, for example, 20 psi. When the pressure in the manifold 82 drops below the pressure in the receiver 22 by the threshold value of the pressure differential valve 81, the pressure differential valve 81 opens and discharges the liquid refrigerant 78 into the manifold 82. Thus pressure differential valve 81 will allow liquid to flow from receiver 22 to manifold 82 only if the pressure in receiver 22 exceeds the pressure in manifold 82 by 20 psi or more.

Valve 24 is closed to prevent fluid communication between the evaporator coils 32, 34 and the compressors 12, 13. Valve 120 is opened to allow gas refrigerant 14 to discharge from receiver 22 via line 118, into the outlet ends 89 of the evaporator coils 32, 34 thereby reversing its normal flow direction. The gas refrigerant then passes through the coils 32, 34 releases heat, condenses to a liquid refrigerant, and may be subcooled, as it passes through the evaporator coils 32, 34, which are at a relatively low temperature. The electronic control valves may also be controlled to maintain subcooling of the refrigerant in reverse flow across the evaporator coils 32, 34. Subcooling control may be maintained by modulating the duty cycle of the pulse modulated solenoid valve 120. For example, when the amount of subcooling increases, the refrigerant flow is increased. Similarly, when the amount of subcooling decreases, the flowrate of refrigerant is decreased.

As the gas refrigerant condenses to a liquid refrigerant, it gives up thermal energy (heat) thereby heating the evaporator coils, melting the ice, and defrosting the evaporator coils. The electronic control valves used as flow controls 36, 38 are opened to allow the liquid refrigerant to pass to the manifold 82 and to the other evaporator systems such as system 40.

During the defrost cycle, flow control is performed across each evaporator coil 32, 34 and the control circuit 50 continually monitors the temperature of the refrigerant at the inlet end 88 and outlet end 89 of each of the evaporator coils 32, 34. The control circuit 50 receives signals from the various sensors in the refrigeration system 10 and in response thereto and in accordance with instructions provided to the control circuit 50 by a software means controls the operation of the various system elements including refrigerant flow into the evaporator coils 32, 34 and 42, 44. For example, when the temperature of the refrigerant at the inlet end 88 of a particular coil 32 reaches a predetermined temperature as compared to the temperature at the outlet end 89, the control valve 36 associated with that coil 32 throttles down, decreasing the flowrate of refrigerant to the remaining coil 32. Alternatively, control valve 36 may also be controlled based on only the measured temperature and pressure at the inlet end 88 of a particular coil 32. This allows calculation of the amount of subcooling by control circuit 50, and allows control of control valve 36 to provide subcooling of refrigerant flowing through coil 32 during defrost. In practice, the evaporator coils 32, 34 tend to defrost at different rates due to the differences in the amount of product stored in the fixtures, the amount of ice that has been accumulated on the coils, and the temperature of the coils. By apportioning the flow of refrigerant between evaporator coils 32, 34 and 42, 44, the thermal energy transferred to the evaporator coils during the defrost cycle is distributed only where needed. This optimizes the defrost cycle, and minimizes the energy required to defrost a refrigeration system with multiple evaporator coils.

As mentioned, the refrigerant flow is preferably controlled to maintain subcooling of the refrigerant in reverse flow across the evaporator coils 32, 34. Subcooling may be monitored by the control circuit 50 via monitoring of the temperature and pressure of the refrigerant at the inlet end 88 of each of the evaporator coils 32, 34. Alternatively, the difference in temperature between the outlet end 89 and the inlet end 88 of each of the evaporator coils 32, 34 may be monitored and used to control the amount of subcooling. Subcooling control may be maintained by pulse modulating the solenoid valve 120. For example, when the amount of subcooling as determined by control circuit 50 increases, the refrigerant flow is increased. Similarly, when the amount of subcooling as determined by control circuit 50 decreases, the flowrate of refrigerant is decreased.

When the defrost cycle is complete, i.e. the temperature of the refrigerant at the inlet end 88 of each of the parallel evaporator coils 32, 34 has reached the predetermined temperature, preferably above the freezing point of water, valve 120 closes to shut off the gas refrigerant supply to the outlet ends 89 of evaporator coils 32, 34. Valve 24 is then opened and solenoid operated valve 80 is deactuated to place it in its normal open position, allowing direct flow of refrigerant from receiver 22 to manifold 82, to resume the normal operation of the refrigeration system 10. The above described apparatus and method provides an effective defrost means wherein each evaporator coil 32, 34 is controlled independent of the other and which prevents excessive discharge of the gas refrigerant from the evaporator coils 32, 34 being defrosted to other evaporator coils 32, 34 or other elements of the refrigeration system 10. The energy required to defrost the evaporators is thus minimized by distributing the thermal energy transferred during the defrost cycle only to where it is needed.

The cost of defrosting is reduced because, during defrosting and melting of the ice, the liquid refrigerant passing through the evaporator coils 32, 34 is subcooled and thus refrigeration is performed on the refrigerant liquid by the melting of the ice. The cooling that was stored in the frost on the evaporator coils is recaptured by subcooling the refrigerant.

Figure 2:
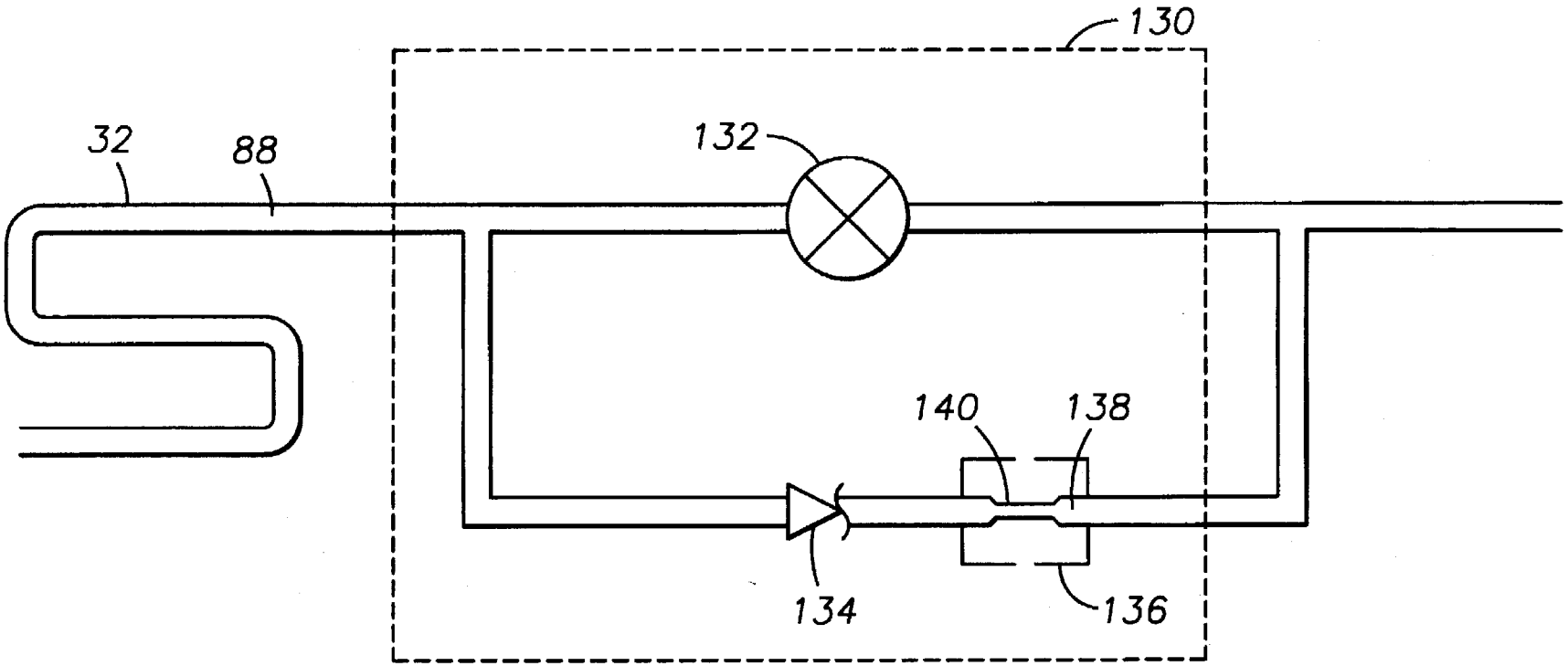
FIG. 2 is schematic diagram of the refrigerant flow control system utilizing a velocity pressure drop means.

Referring now to FIG. 2, there is shown another embodiment of the present invention which may be used as the flow controls 36, 38 during defrost instead of the electronic control valve. The flow control apparatus 130 of this embodiment includes a valve 132 coupled to the coil inlet 88. A serial arrangement of a one way check-valve 134 and a velocity pressure drop means 136 is placed in parallel with the valve 132. The flow through line 88 is controlled in reverse flow by the velocity pressure drop means 136.

The velocity pressure drop means 136 includes a line 138 having a restriction 140. The length of the restriction 140 is the same for all evaporator coils.

The pressure of fluid flowing through restriction 140 will decrease as the fluid passes through the restriction. The size of the line 138 and the size of the restriction 140 determine the pressure drop, for a given flow rate, across the velocity pressure drop means 136. The amount of refrigerant flow through 88 depends on the refrigerant flowing through restriction 140 and its physical properties, i.e., whether it is liquid or gas. Once defrosting is complete, small amounts of gaseous refrigerant begin to pass through the line 88. A small restriction allows relatively more liquid refrigerant through the line than it does gaseous refrigerant. Gaseous refrigerant is one-tenth (1/10) to one-fifteenth (1/15) the volume of the liquid. Thus, the restriction is a flow limiting device at the completion of the defrost cycle.

The device 136 is designed so that the pressure drop across the device is equal to or greater than the largest pressure differential of any of the one-way check valves used in the parallel evaporators 32, 34. Generally, it is desirable to use velocity pressure drop devices 136 which have a pressure drop that is substantially greater than the pressure drop of any of the one-way check valves of the evaporator system 30. This ensures that during the defrost cycle, all check-valves remain open when the gas refrigerant is being discharged into the evaporator coils 32, 34 during the defrost cycle, thereby assuring that all evaporator coils 32, 34 will defrost.

With the velocity restriction, the problem of the check valves not allowing gas refrigerant to flow through is solved because the liquid is able to pass through the restriction 140. However, once the frost has melted and disappeared, the flow of the mass of refrigerant in the gaseous phase is reduced through the restriction. Thus, in this embodiment, the restriction 140 acts as a velocity flow controller, and minimizes the transfer of thermal energy to an evaporator coil that needs no further defrosting.

In another embodiment of the present invention employing liquid, rather than gas, refrigerant in reverse flow, the apparatus required to effect defrost is essentially the same. In this case the connection of line 119 with valve 121 to receiver 22 is made below the level of the liquid refrigerant 78 in receiver 22. This ensures that defrost is performed by refrigerant liquid. Line 119 and the evaporator coils are flushed of liquid following defrosting by the gas from line 118A by cycling valve 120A on and 120 off at the end of the defrost cycle.

The operation of the refrigeration system using the alternative embodiment of FIG. 2 as the flow control means is described below with reference to the evaporator system 30. This explanation equally applies to other evaporator systems in the refrigeration system 10, such as the evaporator system 40. During the defrost cycle, the gas refrigerant is discharged into the evaporator coils 32, 34 of the evaporator system 30. The gas refrigerant condenses into a liquid refrigerant in the evaporator coils 32, 34 and the one way check-valves open because the pressure drop between the gas refrigerant and the line 84 is greater than the threshold pressure differential of the one way check-valves, thereby allowing the refrigerant to pass in reverse flow from the evaporator coils 32, 34 to the line 84. The velocity pressure drop means 136 assures that the combined pressure drop of check valve 134 and restriction 140 remains above the threshold pressure drop value of each of the one-way check valves in the evaporator system 30, thereby ensuring that all such check valves will remain open during the defrost cycle. When the desired amount of defrost has occurred, the control valve 120 is closed to resume the normal operation of the refrigeration system 10.

The pressure drop means 136 provides a relatively inexpensive mechanical means for ensuring that refrigerant will continue to flow through each of the parallel evaporator coils 32, 34 during the entire defrost cycle, thereby ensuring that thermal energy is distributed to coils that are frosted and therefore that each such coil 32, 34 will defrost. In the prior art refrigeration systems using one-way check valves to control the refrigerant flow, the one-way check valve having the lowest pressure drop will remain open while the remaining check valve may remain closed, thereby not effectively defrosting all the evaporator coils. Such prior art systems also allow the gas refrigerant from the evaporators to pass into the line 84 and thereby to other evaporator systems, such as system 40, which as described earlier is highly undesirable. The above-described apparatus and method provides a more efficient means for effecting the defrost of the evaporator coils 32, 34 and 42, 44 in a refrigeration system 10 compared to a system utilizing check-valves alone, and also reduces the discharge of the gas refrigerant through the evaporator coils 32, 34 and 42, 44 during the end of the defrost cycle.

The foregoing descriptions are directed to particular embodiments of the invention for the purpose of illustration and explanation. It will be apparent, however, to one skilled in the art that many modifications and changes to the embodiments set forth above are possible without departing from the scope and the spirit of the invention. It is intended that the following claims be interpreted to embrace all such changes and modifications.

What is claimed is:

1. An apparatus for uniformly defrosting parallel evaporators in a refrigeration system by passing a high pressure fluid refrigerant through the evaporators during a reverse flow defrost cycle, comprising:

(a) a first flow control member disposed at an inlet of a first evaporator, for controlling the flow of the fluid refrigerant through the first evaporator;

(b) a second flow control member disposed at an inlet of a second evaporator, for controlling the flow of the fluid refrigerant through the second evaporator; and (c) said first and second control members apportioning the fluid refrigerant between the first and second evaporators during the defrost cycle to distribute the energy between the evaporators.

2. The apparatus of claim 1, further comprising a gas discharging means for displacing the fluid refrigerant by discharging a high pressure gas refrigerant into an outlet of the first and second evaporators.

3. The apparatus of claim 1 wherein said first and second flow control members are velocity limiting members for limiting the velocity of the fluid refrigerant during the defrost cycle.

4. The apparatus of claim 3 wherein upon a decrease of the subcooling of the liquid refrigerant in one of the parallel evaporators, said flow control member for such evaporator decreases the rate of the mass of refrigerant flowing through that evaporator.

5. The apparatus of claim 1 further comprising a temperature sensor at each inlet of the evaporators for sensing the temperature of the refrigerant at each inlet.

6. The apparatus of claim 1 wherein said first and second flow control members are flow control valves controlled by a control circuit.

7. The apparatus of claim 6 further including:

(d) first and second temperature sensors at the inlets of the first and second evaporators respectively, for sensing the temperature of the fluid refrigerant at the inlets of the evaporators; and (e) control circuitry closing said first flow control member when the temperature of the fluid refrigerant at the inlet of the first evaporator reaches a first predetermined temperature, and closing said second flow control member when the temperature of the fluid refrigerant at the inlet of the second evaporator reaches a second predetermined temperature.

8. The apparatus of claim 7 wherein the first predetermined temperature and the second predetermined temperature are the same temperature.

9. The apparatus of claim 7, further comprising:

(f) a compressor for compressing said refrigerant to a compressor outlet;

(g) a refrigerant line connecting said compressor outlet to the outlet of each of the evaporators, for transporting the refrigerant from the compressor outlet to the evaporator outlets; and (h) a valve in said refrigerant line for regulating the flow of refrigerant to the evaporator outlets.

10. An apparatus for uniformly defrosting at least first and second evaporators in a refrigeration system by passing a refrigerant through the evaporators, comprising:

(a) a first flow control member at the inlet of the first evaporator for controlling the flow of the refrigerant through the first evaporator;

(b) a second flow control member at the inlet of the second evaporator for controlling the flow of the refrigerant through the second evaporator;

(c) first and second temperature sensors at the inlets of the first and second evaporators respectively and third and fourth temperature sensors at the outlets of the first and second evaporators respectively, for sensing the temperature of the refrigerant at the inlets and outlets of the evaporators;

(d) control circuitry receiving signals from said temperature sensors and monitoring the temperatures of the refrigerant at the inlet and outlet of each of the evaporators;

(e) said control circuitry closing said first flow control member when the difference between said third and first temperature sensors falls below a first predetermined value, and closing said second flow control member when the difference between said fourth and second temperature sensors falls below a second predetermined value.

11. An apparatus for uniformly defrosting at least first and second evaporators in a refrigeration system by passing a defrosting refrigerant through the evaporators in reverse flow, comprising:

first and second defrosting liquid flow control members disposed at the inlets of the first and second evaporators, respectively; and said first flow control member restricting the flow of defrosting refrigerant through the first evaporator such that the flow through said first evaporator is substantially the same as the flow through said second evaporator until one of the evaporators is substantially defrosted.

12. The apparatus of claim 11, wherein said first and second flow control members maintain the pressure drop of defrosting refrigerant flowing through said first and second flow control members substantially the same.

13. The apparatus of claim 11, wherein said flow control members cause the pressure drop of defrosting refrigerant flowing through said first flow control member to be substantially equal to the total pressure drop across the first evaporator, and the pressure drop of defrosting refrigerant flowing through said second flow control member to be substantially equal to the total pressure drop across the second evaporator.

14. The apparatus of claim 11, wherein said flow control members each comprise:

a first conduit member having a one way check valve for passing refrigerant when the pressure drop across the check valve exceeds a predetermined pressure drop and a flow restrictor in series with said check valve for increasing the pressure drop of refrigerant flowing through said flow control members and a second conduit member in parallel with said first conduit member, and having a valve.

15. The apparatus of claim 11, wherein said flow control members each comprise a flow restrictor connected at the inlet of each evaporator for increasing the pressure drop of defrosting refrigerant flowing through said evaporator.

16. An apparatus for controlling the defrosting of evaporators in a refrigeration system having a plurality of evaporators by passing defrosting refrigerant through the evaporators, comprising:

(a) temperature measuring means for measuring the temperature of the defrosting refrigerant discharging from the inlet of each evaporator;

(b) control circuitry receiving signals from said temperature measuring means for monitoring the temperature of the defrosting refrigerant discharging from each evaporator inlet;

(c) flow regulating means connected to each evaporator for varying the flow of said defrosting refrigerant through each evaporator;

(d) said flow regulating means controllably connected to the control circuitry;

(e) said control circuitry controlling the flow regulating means to vary the flow rate of defrosting liquid through each evaporator as a function of the temperature of the defrosting refrigerant discharging from the inlet of each evaporator.

17. A refrigeration system, comprising:

a compressor for compressing a low pressure gas refrigerant;

a condenser coupled to the compressor for condensing the compressed gas refrigerant to a liquid refrigerant;

a receiver coupled to the condenser outlet to which the condensed refrigerant is discharged from the condenser outlet;

at least two evaporator coils for evaporating the liquid refrigerant into the low pressure gas refrigerant, each evaporator coil having an inlet for receiving the liquid refrigerant and an outlet for discharging the low pressure gas refrigerant;

a defrost line connecting said receiver to the outlets of the evaporators, for flowing a defrosting fluid to the evaporators first and second flow control members at the inlets of the first and second evaporator coils respectively, said flow control members each comprising a one way check valve for passing the defrosting fluid through said check valve when the pressure drop across the check valve exceeds a predetermined pressure drop and a flow restrictor connected in series with said check valve for increasing the pressure drop of defrosting fluid flowing through said flow control member.

18. A refrigeration system, comprising:

a compressor for compressing a low pressure gas refrigerant;

a condenser coupled to the compressor for condensing the compressed gas refrigerant to a liquid refrigerant;

a receiver coupled to the condenser outlet to which the condensed refrigerant is discharged from the condenser outlet, at least first and second evaporators for evaporating the liquid refrigerant into the low pressure gas refrigerant;

a defrost line connecting said receiver to the outlets of the evaporators;

a first valve at the inlet of said first evaporator;

a second valve at the inlet of said second evaporator;

a third valve in said defrost line;

temperature sensors at the inlet of each of the evaporators for sensing the temperature of the refrigerant at the inlet of each evaporator;

control circuitry receiving signals from said temperature sensors for monitoring the temperatures of the refrigerant at the inlet of each of the evaporators; and said control circuitry opening said third valve to defrost the evaporators, closing said first valve when the temperature of the refrigerant at the inlet of the first evaporator reaches a first predetermined temperature, and closing said second valve when the temperature of the refrigerant at the inlet of the second evaporator reaches a second predetermined temperature.

19. A refrigeration system, comprising:

a compressor for compressing a low pressure gas refrigerant;

a condenser coupled to the compressor for condensing the compressed high pressure gas refrigerant to a liquid refrigerant;

an evaporator system having at least two parallel evaporator coils for evaporating the liquid refrigerant into the low pressure gas refrigerant;

a separate flow control coupled to the inlet end of each said parallel evaporator coil for controlling the flow of the refrigerant through said coils;

discharging means for discharging the high pressure gas refrigerant into the outlet end of each of said parallel evaporator coils;

flow limiting means for limiting the flowrate of the refrigerant flowing reversely through said parallel evaporator coils as said high pressure gas is discharged into said parallel evaporator coils to effect defrost of said parallel evaporator coils.

20. A refrigeration system, comprising:

a compressor for compressing a low pressure gas refrigerant;

a condenser coupled to the compressor for condensing the compressed gas refrigerant to a liquid refrigerant;

an evaporator system having at least two parallel evaporator coils for evaporating the liquid refrigerant into the low pressure gas refrigerant;

a flow control coupled to the inlet end of each said parallel evaporator coils for controlling the flow of the refrigerant through said coils;

a high pressure gas refrigerant discharging means, said discharging means discharging the high pressure gas refrigerant into the outlet end of each of the parallel evaporator coils;

a temperature sensor disposed at the inlet end of each of the parallel evaporator coils for providing signals representative of the refrigerant temperature at each inlet end; and a control circuit operatively coupled to said flow controls and said temperature sensors, said control circuit determining the refrigerant temperature at each inlet end and closing the flow control to close when the refrigerant temperature at the inlet end of its associated coil is at or above a predetermined value.

21. A refrigeration system, comprising:

a compressor for compressing a low pressure gas refrigerant;

a condenser coupled to the compressor for condensing the compressed gas refrigerant to a liquid refrigerant;

an evaporator system having at least two parallel evaporator coils for evaporating the liquid refrigerant into the low pressure gas refrigerant;

means for discharging the compressed gas refrigerant into the outlet end of each of the parallel evaporator coils;

a flow control apparatus coupled to the inlet end of each said parallel evaporator coil for controlling the flow of the refrigerant into each such evaporator coil, said flow control apparatus comprising:

an expansion valve coupled to the inlet end of the evaporator coil for controlling the flow of the liquid refrigerant into the evaporator coil; and coupled in parallel with said expansion valve, a one way check-valve placed in series with a velocity pressure drop member, said velocity pressure drop member having a pressure sufficient to ensure that said check valve will remain open as long as the compressed gas is discharged into the associated evaporator coil.

22. A method for uniformly defrosting a plurality of evaporators in a refrigeration system, comprising the steps of:

(a) passing a defrosting refrigerant gas through the evaporators;

(b) controlling the flow rate of defrosting refrigerant through each evaporator to subcool the refrigerant;

(c) measuring the temperature of the defrosting refrigerant discharged from each of the evaporators; and (d) stopping the flow of defrosting refrigerant gas through an evaporator when the temperature of the defrosting refrigerant discharged from the evaporator reaches a predetermined temperature.

23. The method of claim 22, wherein step (d) comprises:

measuring the temperature of the defrosting refrigerant entering each evaporator; and stopping the flow of defrosting refrigerant gas through an evaporator when the difference between the temperature of the refrigerant discharging from the evaporator and the temperature of the refrigerant entering the evaporator reaches a predetermined value.

24. The method of claim 23, in which the step of controlling the flowrate of the defrosting refrigerant through each evaporator coil is performed by a microcontroller.

* * * * *